US008083486B1

(12) United States Patent
Liang

(10) Patent No.: US 8,083,486 B1
(45) Date of Patent: Dec. 27, 2011

(54) TURBINE BLADE WITH COOLING FLOW MODULATION

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 370 days.

(21) Appl. No.: 12/466,573

(22) Filed: May 15, 2009

(51) Int. Cl.
*F01D 5/08* (2006.01)
*F01D 5/20* (2006.01)
*F03B 11/00* (2006.01)

(52) U.S. Cl. ..... 416/97 R; 416/95; 416/96 R; 415/115

(58) Field of Classification Search ..... 416/95, 416/96 R, 97 A, 97 R; 415/115
See application file for complete search history.

(56) References Cited

U.S. PATENT DOCUMENTS

2005/0084370 A1* 4/2005 Gross ..... 416/95
2005/0265836 A1* 12/2005 Mongillo et al. ..... 416/1
* cited by examiner

*Primary Examiner* — Ha Tran T Nguyen
*Assistant Examiner* — Aaron Dehne
(74) *Attorney, Agent, or Firm* — John Ryznic

(57) ABSTRACT

A turbine rotor blade with a 3-pass serpentine flow cooling channel having a first leg located at the leading edge of the airfoil and a third leg located adjacent to the trailing edge of the airfoil and connected to a row of exit slots, and in which a second leg includes three separate channels in parallel with inlet metering holes to regulate a cooling air flow and pressure in each separate channel. The blade includes a blade tip channel connected to the first leg of the serpentine and which supplies the cooling air to the second leg channels through the separate metering holes. Because the metering holes can be sized individually, the hottest part of the mid-chord region of the airfoil can be supplied with more cooling air flow and the pressure ratio across the trailing edge can be reduced so that the exit slots can be larger or more numerous.

9 Claims, 3 Drawing Sheets

TURBINE BLADE WITH COOLING FLOW MODULATION

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a large cord air cooled turbine rotor blade with cooling flow modulation.

2. Description of the Related Art Including Information Disclosed Under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

It is well known in the art of gas turbine engine design that the efficiency of the engine can be increased by passing a higher gas flow temperature through the turbine. However, the turbine inlet temperature is limited by the material properties of the turbine, especially for the first stage airfoils since these are exposed to the highest temperature gas flow. As the gas flow passes through the various stages of the turbine, the temperature decreases as the energy is extracted by the rotor blades.

Another method of increases the turbine inlet temperature is to provide more effective cooling of the airfoils. Complex internal and external cooling circuits or designs have been proposed using a combination of internal convection and impingement cooling along with external film cooling to transfer heat away from the metal and form a layer of protective air to limit thermal heat transfer to the metal airfoil surface. However, since the pressurized air used for the airfoil cooling is bled off from the compressor, this bleed off air decreases the efficiency of the engine because the work required to compress the air is not used for power production. It is therefore wasted energy as far as producing useful work in the turbine.

FIG. 1 shows an external heat transfer coefficient (HTC) profile for a first stage turbine rotor blade in an industrial gas turbine engine. As seen in FIG. 1, the airfoil leading edge and trailing edge as well as the forward region of the suction side surface experiences a high hot gas heat transfer coefficient while the mid-chord section of the airfoil is at a lower hot gas HTC than the LE and TE and the forward suction side sections of the airfoil. The suction side TE is represented by the end of the line on the left side of the graph, the low point of the two dips represents the mid-chord sections of the airfoil, the high point on the graph represents the leading edge, and the end of the line of the right side of the graph represents the trailing edge.

BRIEF SUMMARY OF THE INVENTION

It is an object of the present invention to provide for a turbine airfoil with a serpentine flow cooling circuit that has cooling flow and pressure modulation capability.

It is another object of the present invention to provide for a turbine airfoil with a reduced pressure ratio across the trailing edge in order to provide for larger trailing edge exit holes or slots, or a larger number of exit holes or slots along the trailing edge.

It is another object of the present invention to provide for a turbine airfoil with a serpentine flow cooling circuit that prevents trailing edge overflow to minimize an impact of the serpentine second leg outflow margin and leading edge showerhead back-flow margin if a showerhead arrangement of film cooling holes is used in the leading edge region of the airfoil.

It is another object of the present invention to provide for a turbine airfoil with a serpentine flow cooling circuit with a reduced pressure ratio across the airfoil trailing edge than in the prior art 3-pass serpentine flow circuits.

It is another object of the present invention to provide for a turbine airfoil with a serpentine flow cooling circuit that allows for larger exit cooling holes or slots or a larger number of the slots or holes than in the prior art 3-pass serpentine flow circuits.

These objectives and more can be achieved by the turbine rotor blade serpentine flow cooling circuit of the present invention which includes a 3-pass aft flowing serpentine cooling circuit with a first leg adjacent to the leading edge region and a third leg located adjacent to the trailing edge region to supply cooling air to a row of trailing edge exit slots or holes, and where the second leg of the 3-pass serpentine circuit includes three parallel channels to provide customized cooling air flow and pressure to the three different sections of the mid-chord region of the airfoil. Each separate channel in the second leg includes a metering hole at the inlet that can be sized to produce a different cooling air flow and pressure in that particular channel depending on the metal temperature and, if film cooling holes are used, to produce enough cooling air pressure to prevent backflow into the film holes from the hot gas flow.

The three channels of the second leg all discharge into a common cooling air collector chamber or cavity located in the root section of the blade and then channeled into the third leg along the trailing edge region.

DETAILED DESCRIPTION OF THE INVENTION

Figure 1:
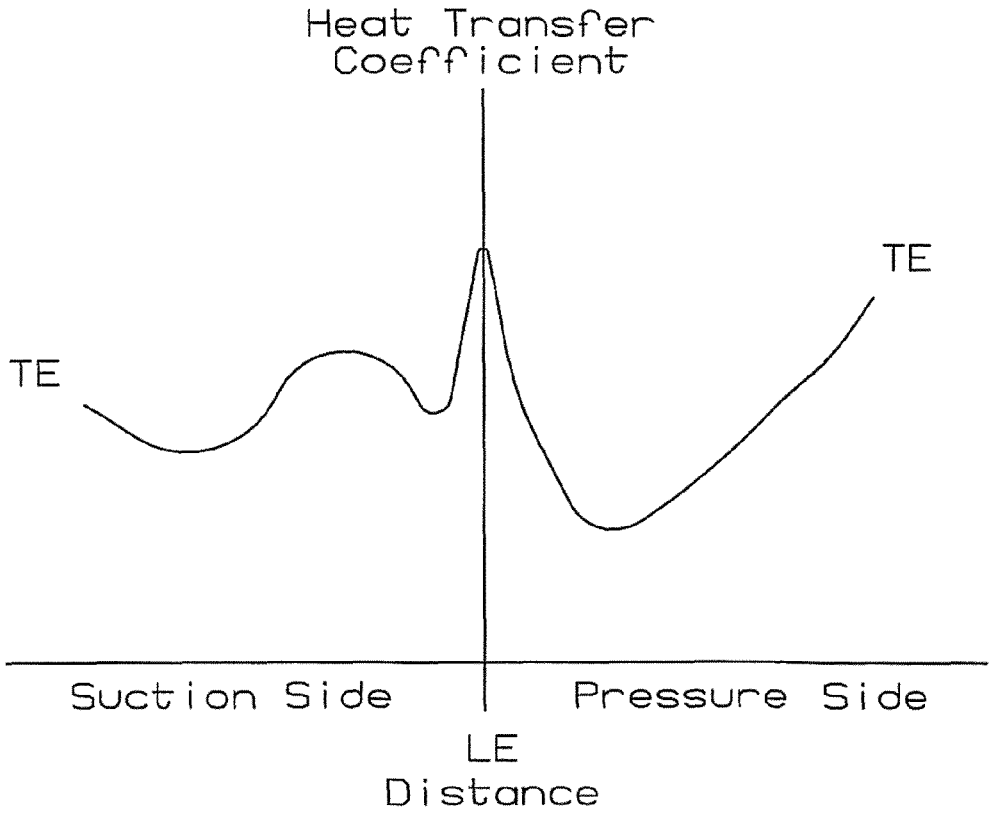
Fig 1 Prior Art
FIG. 1 shows a graph of an airfoil external heat transfer coefficient distribution for a first stage blade used in an industrial gas turbine engine.
Figure 2:
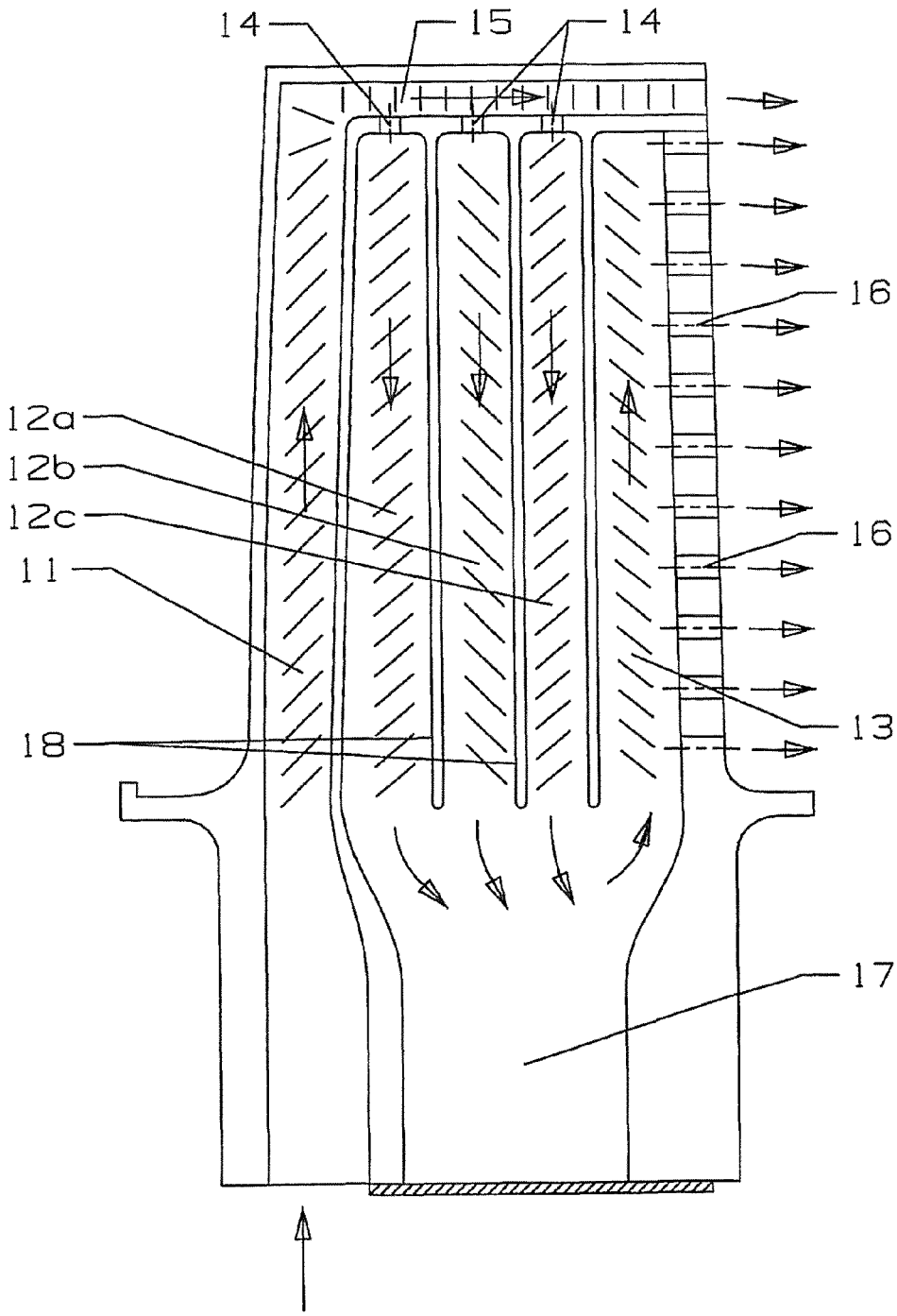
FIG. 2 shows a cross section view of the serpentine flow cooling circuit in the present invention.

The present invention is an air cooled turbine rotor blade for use in a first or second stage of an industrial gas turbine engine. However, the serpentine flow cooling circuit of the present invention can even be used in an aero engine blade. FIG. 2 shows a cross section of the turbine blade of the present invention with the serpentine flow cooling circuit. the cooling circuit is a 3-pass or triple pass serpentine aft flowing circuit with a first leg or channel 11 located along the leading edge of the airfoil, three channel that form the second leg of the serpentine and include a first second leg channel 12*a* and a second second leg channel 12*b* and a third second leg channel 12*c*, and a third leg or channel 13 arranged along the trailing edge region of the airfoil. The first leg 11 is connected directly to a blade tip cooling channel 15 that extends along the entire blade tip and discharges out the tip corner on the trailing edge. A row of exit slots 16 is arranged along the trailing edge preferably on the pressure side wall that is connected to the third leg 13 and discharges the cooling air to provide cooling for the trailing edge region. A metering hole 14 is formed at the entrance of each of the three channels in the second leg 12 to meter the cooling air flow and the pressure in the separate second legs 12*a-c*. A common cooling air collector cavity 17 is formed in the root section in which the second legs 12*a-c* all discharge into before flowing into the third leg 13. Trip strips are used on the walls of the channel to enhance the heat transfer to the cooling air flow.

Figure 3:
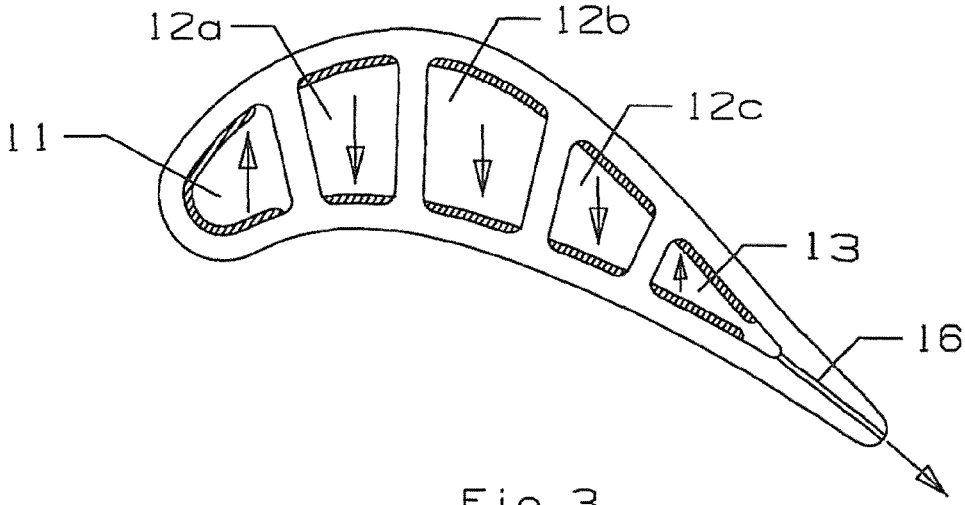
FIG. 3 shows a cross section top view of the turbine blade cooling circuit of the present invention.
Figure 4:
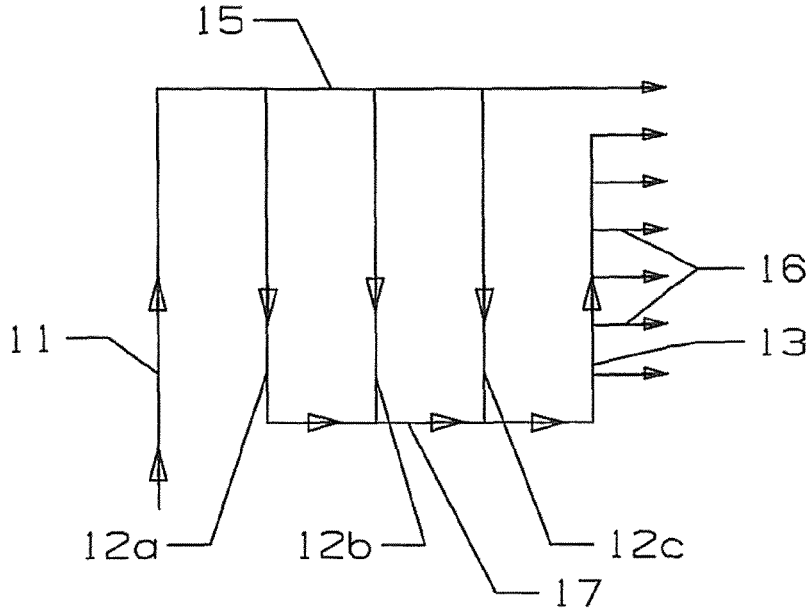
FIG. 4 shows a flow diagram of the serpentine flow cooling circuit of the present invention in FIG. 2.

FIG. 3 shows a cross section top view of the blade with the serpentine flow cooling circuit of FIG. 2. The blade in this embodiment does not include film cooling holes on the leading edge or on either of the pressure side or suction side walls. However, film cooling holes can be included in other embodiments to provide film cooling to any surface of the blade airfoil that is required. As seen in FIG. 3, trip strips located along the walls of the channels are used to promote heat transfer from the hot metal surface to the cooling air flowing along the channels. FIG. 3 shows a diagram of the cooling air flow through the blade with the serpentine flow cooling circuit.

The first leg 11 of the 3-pass serpentine flow circuit provides cooling for the airfoil leading edge. The second legs 12*a-c* provides cooling for the airfoil mid-chord section that is sub-divided into three individual flow channels that are separated by dummy ribs 18. The third leg 13 provides cooling for the airfoil aft section as well as cooling air for the exit slots on the trailing edge region. In order to achieve a uniform sectional metal temperature distribution, a re-distribution of the cooling air flow within the 3-pass serpentine flow circuit is required.

A stepped down cooling flow or pressure modulation device is built in at the entrance of each individual mid-chord cooling flow channel 12*a-c* to better control the cooling flow rate and pressure level within the second leg 12 of the 3-pass serpentine flow circuit. the metering device is used to regulate the cooling flow rate into each of the individual and separate channels 12*a-c*, the out flow margin (OFM) for the second leg 12 of the cooling passage, and the pressure level for each of the individual flow channels for a better match to the external gas side pressure level. As a result of lowering the cooling flow channel pressure, a higher internal cooling flow Mach number is achieved with a higher internal heat transfer coefficient to produce a much better cooling performance than in the prior art serpentine flow circuits.

In operation, the total cooling air is supplied through the airfoil leading edge channel of the serpentine flow circuit which then flows into the blade tip cooling passage to provide cooling for the leading edge and the blade tip with fresh relatively cool cooling air. From the tip channel 15, the cooling air is metered through the three separate metering holes 14 to flow into the three second leg channels 12*a-c* under the same or a different flow volume and pressure. Since the heat load for the airfoil mid-chord region increases toward the trailing edge, more cooling air is required for the aft portion of the airfoil mid-chord channel 12*c*. The spent cooling air is then discharged into the common collector cavity 17 located below the blade platform in the root section. The cooling flow design and process eliminates any over-cooling of the airfoil mid-chord region and cooling air heat up which yields a better cooling potential for use in cooling of the trailing edge region. The spent cooling air is then discharged along the trailing edge of the airfoil to provide cooling for this section. A well thermally balanced airfoil cooling design is thus achieved.

Major design features and advantages of the cooling circuit of the present invention over the prior art 3-pass aft flowing serpentine flow circuit are described below. The built in cooling flow modulation device at the entrance section of the airfoil mid-chord flow channels allows for the cooling flow and pressure to the airfoil mid-chord section to be modulated. The built in metering devices for the second leg of the serpentine flow circuit can be cast in or machined for the adjustment of the flow area to fine tune the cooling flow and pressure to each individual flow channel 12*a-c*. constructing a built in metering device for the serpentine flow circuit provides for a robust cooling flow control capability for the integrated aft flowing serpentine circuit of the present invention. With the built in metering device for the mid-chord serpentine flow channel that provides the capability to reduce the pressure ratio across the airfoil trailing edge, a larger exit hole size or more exit cooling slots can be used for the trailing edge which improves the trailing edge flow control and cooling performance. The built in metering device at the mid-chord serpentine flow channel prevents the trailing edge overflow, and thus minimizes the impact of the serpentine second leg outflow margin (OFM) and leading edge showerhead back-flow margin (BFM) if a showerhead arrangement of film cooling holes is used in the first leg of the serpentine flow circuit. The built in metering device at the second leg of the serpentine flow channel increases the integrated serpentine flow circuit design flexibility. The blade leading edge showerhead back flow margin (BFM) and serpentine second leg down-pass out flow margin (OFM) can be enhanced by adjusting the cooling air supply pressure upward without creating an excessive pressure ratio across the airfoil trailing edge.

I claim the following:

1. An air cooled turbine rotor blade comprising:

an airfoil section having a leading edge, a pressure side wall and a suction side wall, and a blade tip;

the airfoil being formed with a 3-pass serpentine flow cooling air circuit with a first leg located adjacent to the leading edge of the airfoil and a third leg located in a trailing edge region of the airfoil;

a blade tip cooling channel connected to the first leg of the 3-pass serpentine flow circuit to provide cooling for the blade tip;

a second leg of the 3-pass serpentine flow cooling circuit having a plurality of parallel and separated channels each being connected to the blade tip cooling channel, the plurality of parallel and separated channels each discharging into a collector cavity within a root section of the blade and, a metering hole for each of the parallel and separated channels to meter a cooling air flow and pressure into each of the channels.

2. The air cooled turbine rotor blade of claim 1, and further comprising:

the second leg of the 3-pass serpentine flow circuit consists of three channels.

3. The air cooled turbine rotor blade of claim 1, and further comprising:

the collector cavity located within a root section of the blade to connect the second leg channels to the third leg of the serpentine flow circuit.

4. The air cooled turbine rotor blade of claim 1, and further comprising:

a row of exit slots on the trailing edge connected to the third leg to discharge cooling air out from the airfoil.

5. The air cooled turbine rotor blade of claim 1, and further comprising:

the channels of the 3-pass serpentine flow circuit all extend from the blade tip channel to a platform of the blade.

6. The air cooled turbine rotor blade of claim 2, and further comprising:

the metering holes are sized such that more cooling air passing through the aft-most channel of the second leg channels than in the other second leg channels.

7. The air cooled turbine rotor blade of claim 1, and further comprising:

the blade tip channel includes an exit hole at the trailing edge of the airfoil.

8. The air cooled turbine rotor blade of claim 1, and further comprising:

the channels in the second leg are separated by dummy ribs.

9. The air cooled turbine rotor blade of claim 1, and further comprising:

the blade is a first stage blade for an industrial gas turbine engine.

* * * * *